US009999329B2

(12) United States Patent
Hwang et al.

(10) Patent No.: US 9,999,329 B2
(45) Date of Patent: Jun. 19, 2018

(54) ASPIRATION NOZZLE OF VACUUM CLEANER AND VACUUM CLEANER HAVING SAME

(75) Inventors: Mantae Hwang, Changwon-si (KR); Woonghui Won, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 195 days.

(21) Appl. No.: 13/811,864

(22) PCT Filed: Aug. 3, 2010

(86) PCT No.: PCT/KR2010/005089
§ 371 (c)(1),
(2), (4) Date: Jan. 23, 2013

(87) PCT Pub. No.: WO2012/018146
PCT Pub. Date: Feb. 9, 2012

(65) Prior Publication Data
US 2013/0117964 A1 May 16, 2013

(51) Int. Cl.
*A47L 9/02* (2006.01)
*A47L 9/06* (2006.01)
(Continued)

(52) U.S. Cl.
CPC ..... *A47L 9/02* (2013.01); *A47L 9/009* (2013.01); *A47L 9/0653* (2013.01); *A47L 9/242* (2013.01)

(58) Field of Classification Search
CPC ..... A47L 9/00; A47L 9/02; A47L 9/04; A47L 9/06
(Continued)

(56) References Cited

U.S. PATENT DOCUMENTS 6,058,561 A * 5/2000 Song ..... A47L 9/327 15/375
2007/0067949 A1* 3/2007 Lee ..... A47L 9/02 15/421
2008/0313846 A1* 12/2008 Steffen ..... A47L 9/0494 15/339

FOREIGN PATENT DOCUMENTS

JP 61-240929 A 10/1986
JP 2001-218710 A 8/2001
(Continued)

OTHER PUBLICATIONS

JP 2001218710 Machine translation (Industrial Property Digital Library).*
(Continued)

*Primary Examiner* — Christopher M Koehler
*Assistant Examiner* — Stephanie Berry
(74) *Attorney, Agent, or Firm* — KED & Associates, LLP

(57) ABSTRACT

The present invention relates to an suction nozzle for a vacuum cleaner and a vacuum cleaner having same, the suction nozzle of a vacuum cleaner of the present invention comprising: an suction main body having an suction portion for air suction formed thereon; an suction flow channel that is attached to the nozzle main body, and into which the air aspirated through the suction portion flows; an interlocking lever that is coupled in such a manner that enables rotation on both sides of the suction flow channel; an adsorption portion that is connected to one end of the interlocking lever, and provided so as to confront an suction hole formed on the suction flow channel; and a cleaning member provided on one side of the nozzle main body by coupling to the other end of the interlocking lever, wherein the air flowing through the suction hole rotates the interlocking lever by adsorbing or separating the adsorption portion to/from the suction flow
(Continued)

channel, and the cleaning member moves in an up-down direction as the interlocking lever rotates.

20 Claims, 7 Drawing Sheets

(51) Int. Cl.
*A47L 9/00* (2006.01)
*A47L 9/24* (2006.01)

(58) Field of Classification Search
USPC ..... 15/415.1, 339, 319, 365
See application file for complete search history.

(56) References Cited

FOREIGN PATENT DOCUMENTS

| | | | | | |
|---|---|---|---|---|---|
| JP | 2001218710 | * | 8/2001 | ..... | A47L 9/02 |
| KR | 10-2001-0081427 | A | 8/2001 | | |
| KR | 10-2006-0018712 | A | 3/2006 | | |

OTHER PUBLICATIONS

JP 2001218710 (application No. 2000034737) Translation.*
International Search Report dated May 30, 2011 issued in Application No. PCT/KR2010/005089.

* cited by examiner

[Fig. 1]
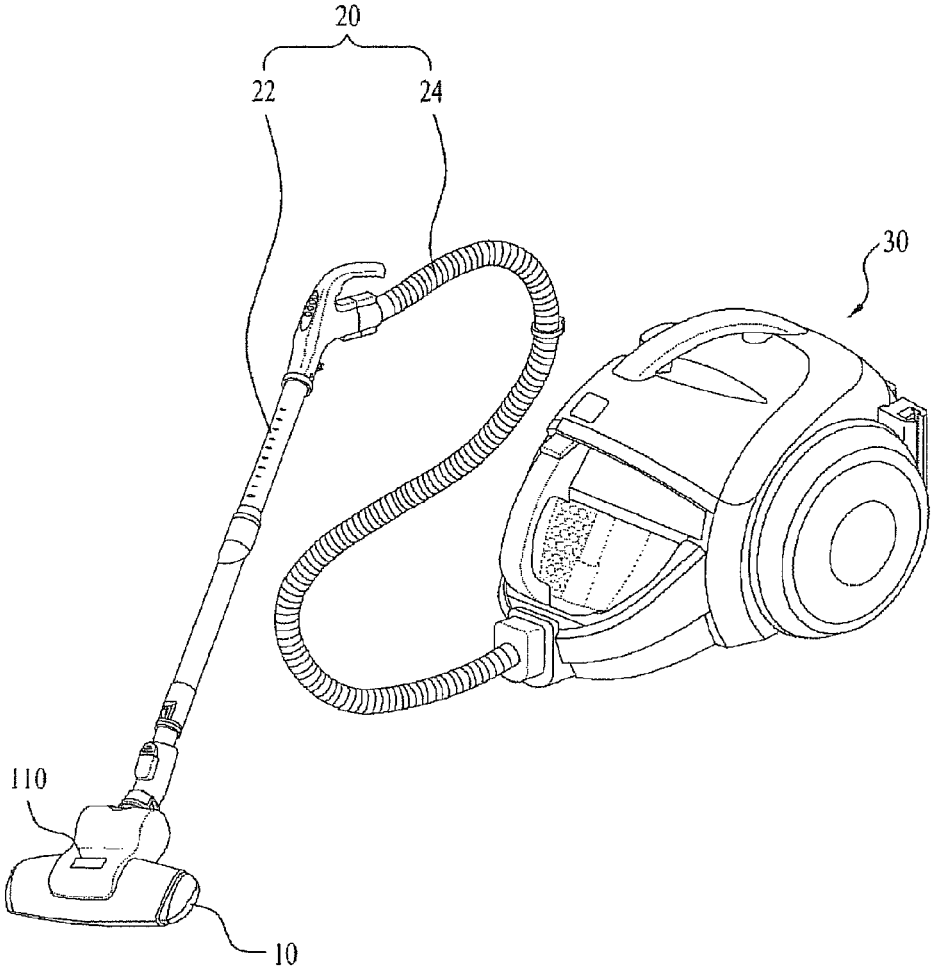

[Fig. 2]
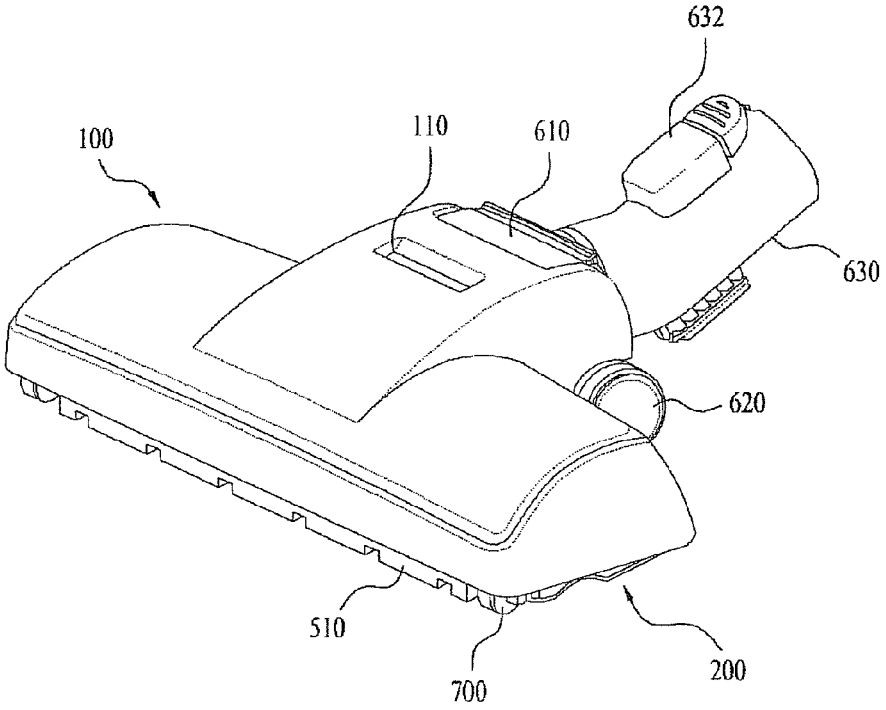

[Fig. 3]
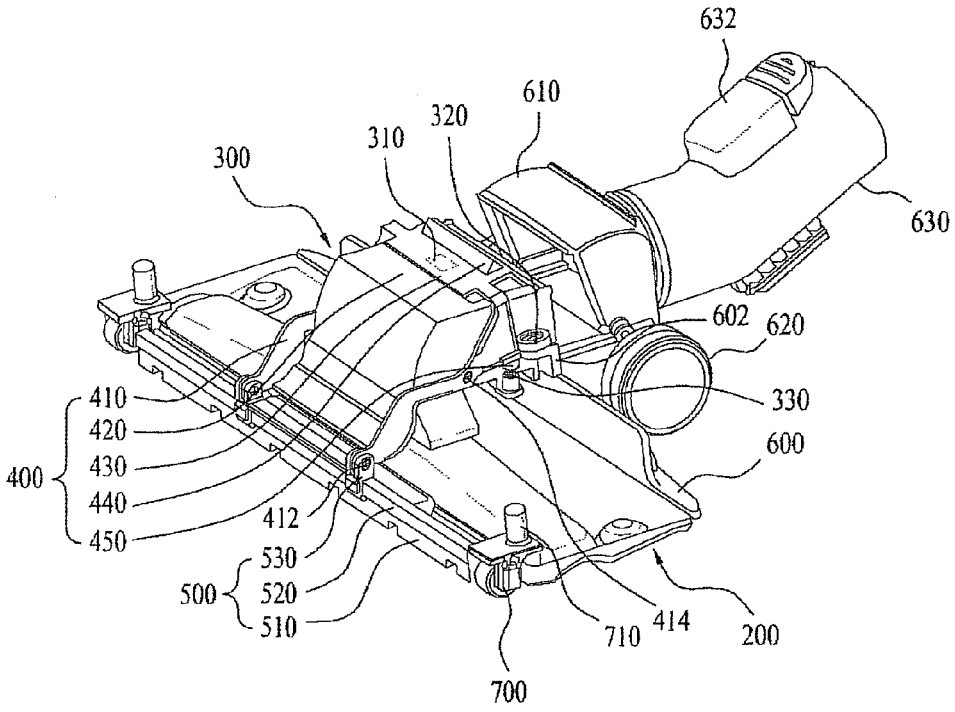

[Fig. 4]
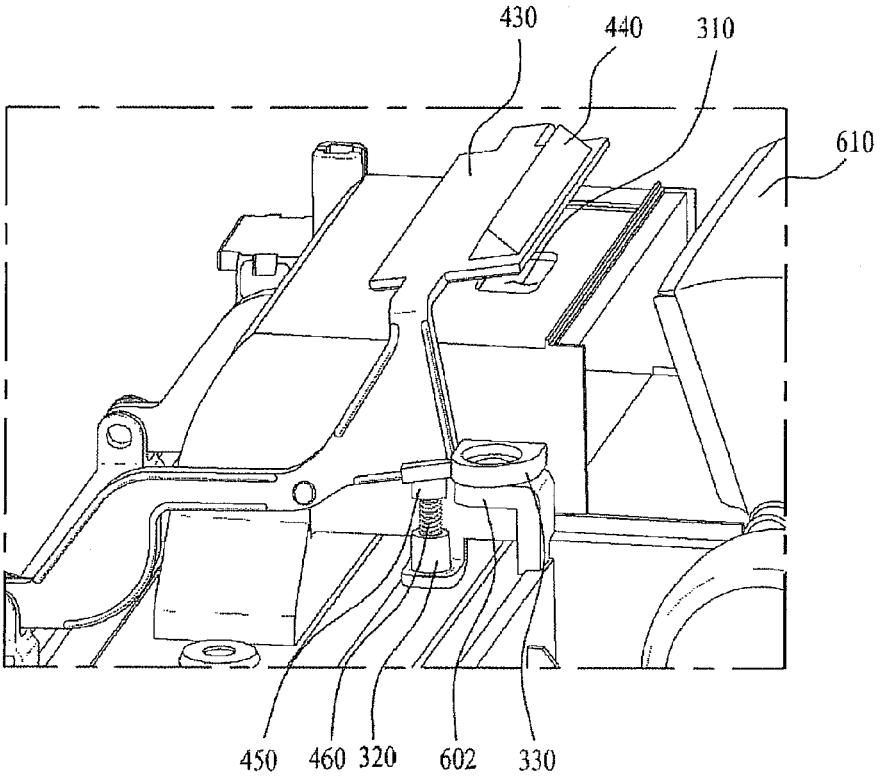

[Fig. 5]
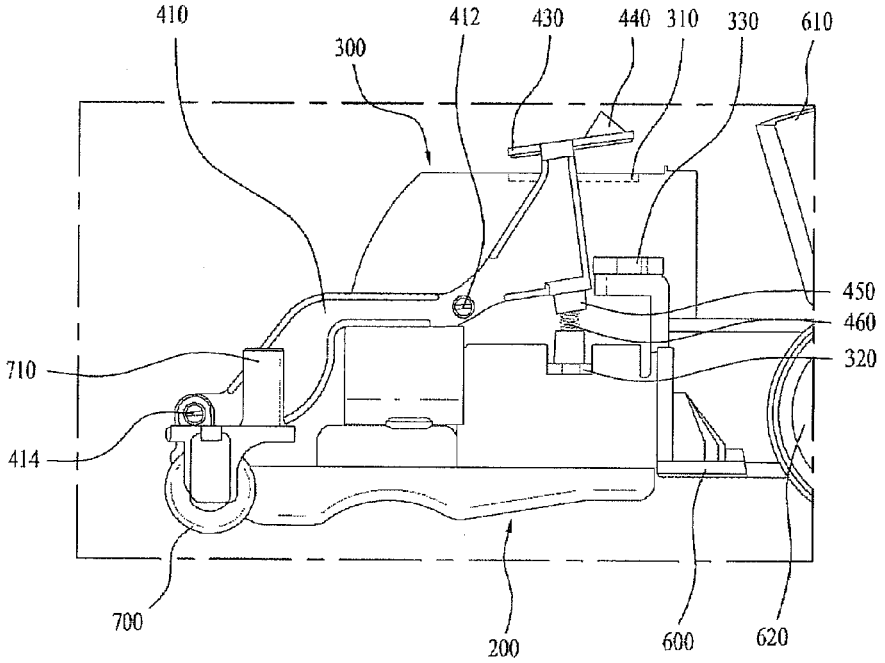
[Fig. 6]
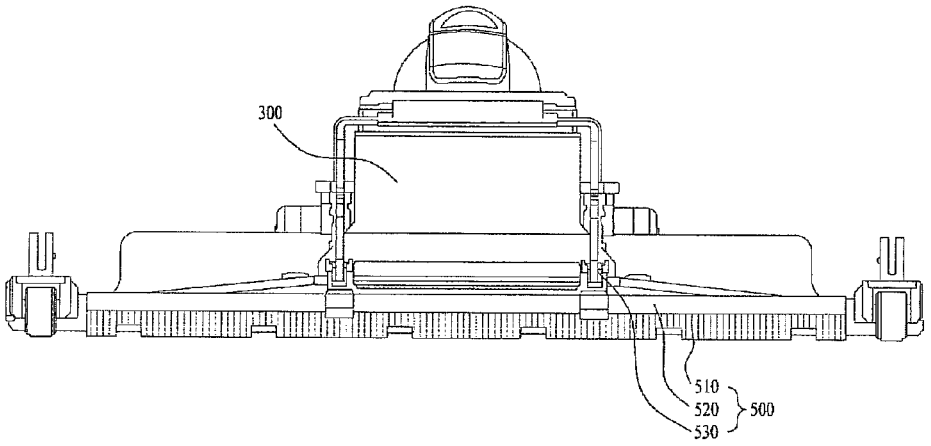

[Fig. 7]
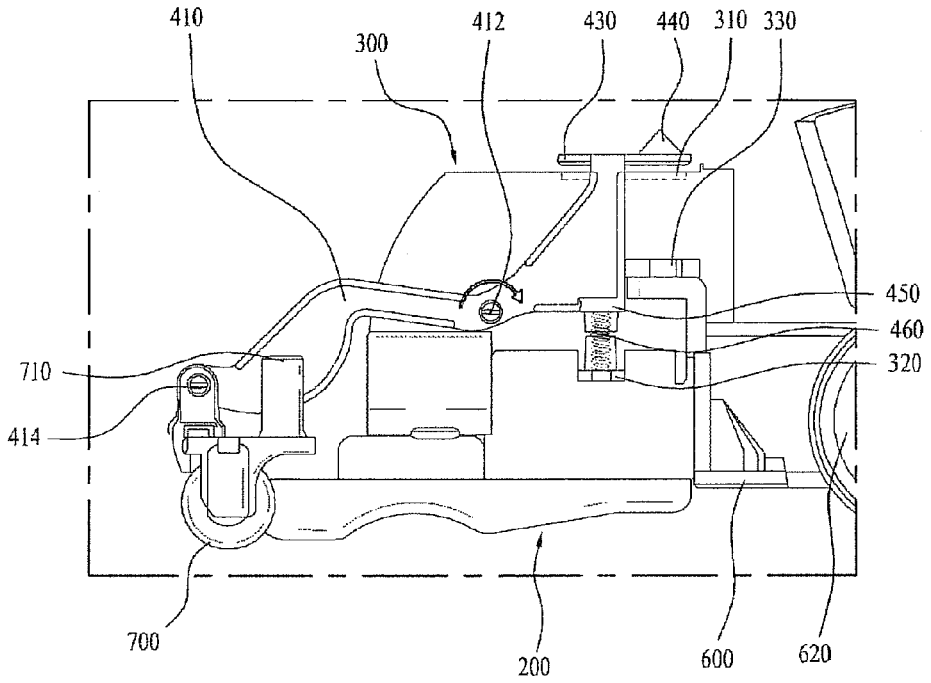
[Fig. 8]
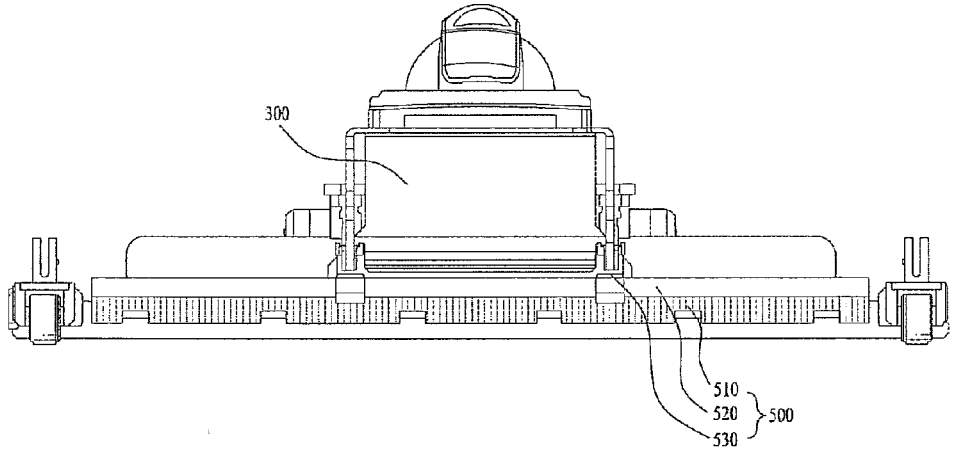

[Fig. 9]
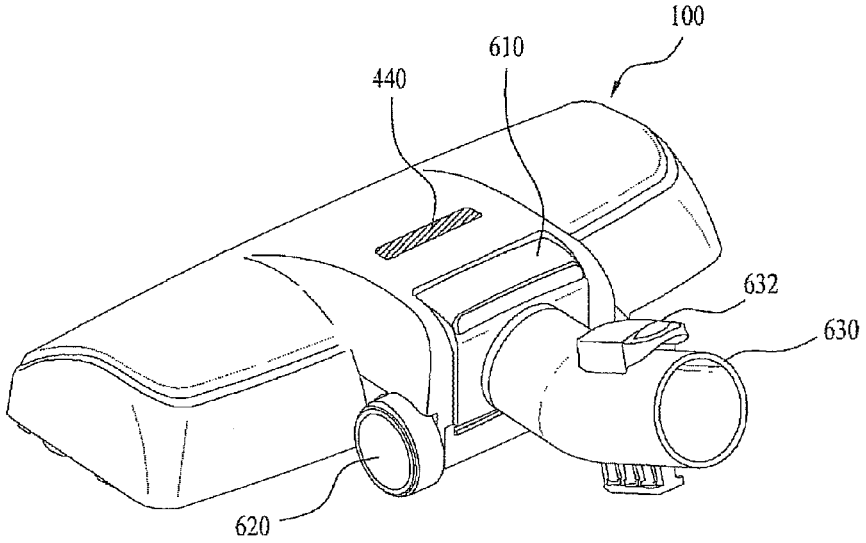
[Fig. 10]
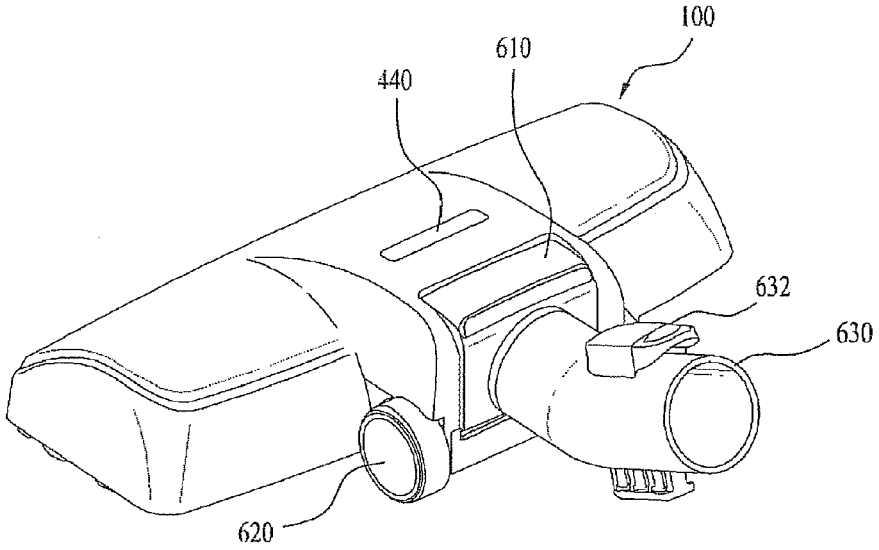

ASPIRATION NOZZLE OF VACUUM CLEANER AND VACUUM CLEANER HAVING SAME

CROSS-REFERENCE TO RELATED PATENT APPLICATIONS

This application is a U.S. National Stage Application under 35 U.S.C. § 371 of PCT Application No. PCT/KR2010/005089, filed Aug. 3, 2010.

TECHNICAL FIELD

The present invention relates to a suction nozzle of a vacuum cleaner and a vacuum cleaner having the same, and more particularly, to a suction nozzle of a vacuum cleaner including a cleaning member and a vacuum cleaner having the same.

BACKGROUND ART

Generally, a vacuum cleaner is a device that suctions dust and foreign matter together with air using a vacuum motor mounted in a cleaner body and then filters the dust and the foreign matter in the cleaner body.

A vacuum cleaner having the aforementioned function may be mainly classified as a canister type vacuum cleaner in which a suction port, i.e. a suction nozzle, is connected to a cleaner body via a connection pipe or an upright type vacuum cleaner in which a suction nozzle is integrated with a cleaner body.

Of the above two vacuum cleaners, the canister type vacuum cleaner includes a cleaner body having a vacuum motor to generate suction force mounted therein, a suction nozzle to suction dust and foreign matter from a surface to be cleaned using the suction force generated from the cleaner body, and an extension pipe and a connection pipe to connect the suction nozzle to the cleaner body.

That is, when the vacuum motor is driven by power supplied to the cleaner body of the vacuum cleaner, suction force is generated by the vacuum motor, and air containing dust and foreign matter from a surface to be cleaned is suctioned into the suction nozzle by the suction force.

The suction nozzle includes a cleaning member, such as a brush, contacting the surface to be cleaned to clean the surface to be cleaned.

Also, moving wheels are provided at the suction nozzle to smoothly move the suction nozzle on the surface to be cleaned. The moving wheels support the suction nozzle such that the bottom of the suction nozzle is spaced apart from the surface to be cleaned.

The air containing dust and foreign matter is introduced into the cleaner body of the vacuum cleaner via the extension pipe and the connection pipe. Dust and foreign matter are separated from the air containing dust and foreign matter introduced into the cleaner body of the vacuum cleaner by a dust separation device mounted at the cleaner body of the vacuum cleaner.

The separated dust and foreign matter are collected in the cleaner body of the vacuum cleaner, and the air, from which the dust and foreign matter have been separated, is discharged from the cleaner body of the vacuum cleaner.

Meanwhile, representative examples of a surface to be cleaned, on which cleaning is performed by the vacuum cleaner, may include a hard floor and a carpet. The hard floor is a smooth surface made of stone, wood, or oilpaper.

In a case in which the vacuum cleaner performs cleaning on such a surface to be cleaned, most dust and foreign matter on the surface to be cleaned are suctioned into the cleaner body of the vacuum cleaner by suction force generated by the vacuum motor. However, dust and foreign matter sticking to the surface to be cleaned or heavy dust and foreign matter are not suctioned into the cleaner body of the vacuum cleaner by suction force generated by the vacuum motor.

In order to solve the above problem, therefore, there has been developed a suction nozzle to which a cleaning member, such as a brush, is coupled to perform cleaning while contacting a surface to be cleaned.

However, the cleaning member is fixed to the suction nozzle with the result that the distance between the bottom of the cleaning member and the surface to be cleaned is uniform. For this reason, it is not easy to uniformly maintain suction force of the vacuum cleaner depending upon kind of a surface to be cleaned, such as a hard floor or a carpet, and therefore, it is not possible to effectively suction dust and foreign matter.

Also, the position of the cleaning member coupled to the suction nozzle is changed simply by user manipulation.

DISCLOSURE

Technical Problem

An object of the present invention devised to solve the problem lies on a suction nozzle of a vacuum cleaner wherein the position of a cleaning member is changed based on kind of a surface to be cleaned and a vacuum cleaner having the same.

Technical problems to be solved by the present invention are not limited to the aforementioned technical problem, and other technical problems will be clearly understood by a person having ordinary skill in the art to which the present invention pertains in view of the following description.

Technical Solution

The object of the present invention can be achieved by providing a suction nozzle of a vacuum cleaner including a suction nozzle body having a suction portion for air suction, a suction channel, provided at the suction nozzle body, in which air suctioned through the suction portion flows, a communication hole provided in the suction channel, a contact portion selectively coming into contact with or separated from the communication hole according to change of pressure in the suction channel, an interlocking lever provided at the suction nozzle body and connected to the contact portion such that the interlocking lever is operated according to motion of the contact portion, and a cleaning member provided at the interlocking lever to move upward or downward according to the operation of the interlocking lever.

In another aspect of the present invention, provided herein is a suction nozzle of a vacuum cleaner including a suction nozzle body having a suction portion for air suction, a suction channel, provided at the suction nozzle body such that the suction channel communicates with the suction portion, in which air suctioned through the suction portion flows, a communication hole provided in the suction channel, a link member rotatably coupled to the suction channel, and a cleaning member coupled to the other end of the link member, wherein the cleaning member moves upward or downward according to the rotation of the link member.

In a further aspect of the present invention, provided herein is a vacuum cleaner including a cleaner body, a vacuum motor provided at the cleaner body, and a suction nozzle to suction air using suction force generated by the vacuum motor, wherein the suction nozzle includes a suction nozzle body having a suction portion for air suction, a suction channel, provided at the suction nozzle body, in which air suctioned through the suction portion flows, a communication hole provided in the suction channel, a contact portion selectively coming into contact with or separated from the communication hole according to change of pressure in the suction channel, an interlocking lever provided at the suction nozzle body and connected to the contact portion such that the interlocking lever is operated according to motion of the contact portion, and a cleaning member provided at the interlocking lever to move upward or downward according to the operation of the interlocking lever.

Advantageous Effects

A suction nozzle of a vacuum cleaner and a vacuum cleaner having the same according to the present invention have effects in that the position of a cleaning member, such as a brush, provided at a suction nozzle to more smoothly perform cleaning on a surface to be cleaned is adjustable based on kind of the surface to be cleaned, thereby easily performing cleaning irrespective of whether the surface to be cleaned is a hard floor or a carpet.

Also, the position of the cleaning member provided at the suction nozzle is automatically adjustable based on kind of the surface to be cleaned. When cleaning is performed on various surfaces to be cleaned, therefore, it is possible to improve user convenience.

DESCRIPTION OF DRAWINGS

FIG. 1 is a perspective view showing a vacuum cleaner according to an embodiment of the present invention;

FIG. 2 is a perspective view showing a suction nozzle according to an embodiment of the present invention;

FIG. 3 is a perspective view showing a state in which a cover of the suction nozzle according to the embodiment of the present invention is removed;

FIG. 4 is a perspective view showing a suction hole, formed in a suction channel, and a contact portion, facing the suction hole, of the suction nozzle according to the embodiment of the present invention;

FIG. 5 is a side view showing a state in which the cover of the suction nozzle according to the embodiment of the present invention is removed in a case in which a surface to be cleaned is a hard floor;

FIG. 6 is a front view showing a state in which the cover of the suction nozzle according to the embodiment of the present invention is removed in a case in which the surface to be cleaned is the hard floor;

FIG. 7 is a side view showing a state in which the cover of the suction nozzle according to the embodiment of the present invention is removed in a case in which a surface to be cleaned is a carpet;

FIG. 8 is a front view showing a state in which the cover of the suction nozzle according to the embodiment of the present invention is removed in a case in which the surface to be cleaned is the carpet;

FIG. 9 is a perspective view showing an indication protrusion according to an embodiment of the present invention in a case in which a surface to be cleaned is a hard floor; and FIG. 10 is a perspective view showing the indication protrusion according to the embodiment of the present invention in a case in which a surface to be cleaned is a carpet.

BEST MODE

Reference will now be made in detail to the preferred embodiments of the present invention, examples of which are illustrated in the accompanying drawings. In the drawings, sizes and shapes of elements may be exaggerated for convenience and clarity of description. Also, terms specially defined in consideration of the construction and operation of the present invention may vary depending upon intensions of users or operators or usual practices. The definition of such terms must be made based on the disclosure of the present invention.

Furthermore, an idea of the present invention is not limited to embodiments which will be illustrated hereinafter. It may be possible for those skilled in the art who understand the idea of the present invention to easily derive other different embodiments from the disclosure of the present invention within the scope of the same idea, which, of course, fall into the scope of the present invention.

FIG. 1 is a perspective view showing a vacuum cleaner according to an embodiment of the present invention. Hereinafter, the construction and operation of the vacuum cleaner according to the embodiment of the present invention will be described in detail with reference to FIG. 1.

The vacuum cleaner shown in FIG. 1 includes a cleaner body 30 to generate suction force using a vacuum motor, a connection unit 20 to transmit the suction force generated by the cleaner body 30, and a suction nozzle 10 provided at one side of the connection unit 20 to suction dust and foreign matter from a surface to be cleaned together with air.

The vacuum motor is mounted in the cleaner body 30. When the vacuum motor is driven, suction force is generated to suction dust and foreign matter together with air into the cleaner body 30. The suctioned dust and foreign matter are filtered in the cleaner body 30.

The connection unit 20 may include an extension pipe 22 having one end connected to the suction nozzle 10, the length of the extension pipe 22 being adjustable, and a connection pipe 24 connected between the extension pipe 22 and the cleaner body 30. The length of the extension pipe 22 may be adjusted based on the height of a user of the vacuum cleaner or the position of a surface to be cleaned.

During cleaning, the suction nozzle 10 connected to the extension pipe 22 is moved back and forth and from side to side with respect to a surface to be cleaned. For this reason, the connection pipe 24 may be formed of a flexible material so that a user can easily perform cleaning.

FIG. 2 is a perspective view showing a suction nozzle 10 according to an embodiment of the present invention. Hereinafter, the construction of the suction nozzle 10 according to the embodiment of the present invention will be described in detail with reference to FIG. 2.

The suction nozzle 10 mainly includes a suction nozzle body 200 and a cover 100. The cover 100 is coupled to the suction nozzle body 200 to cover the upper part of the suction nozzle body 200. At the top of the cover 100 is formed an indication slit 110, which will hereinafter be described. The indication slit 110 is formed in the shape of a long hole to inform a user of kind of a surface on which cleaning is being performed.

Meanwhile, a suction pipe 630 connected between the suction nozzle 10 and the extension pipe 22 is provided at the rear of the suction nozzle 10. At the top of the suction pipe 630 is provided a connection and disconnection knob 632. When a user wishes to separate the suction nozzle 10 from the extension pipe 22 as needed, for example so as to store the vacuum cleaner, the user may manipulate the connection and disconnection knob 632 to separate the suction nozzle 10 from the extension pipe 22.

At the lower part of the suction nozzle 10 are provided front wheels 700 and rear wheels 620 to smoothly move the suction nozzle 10 during cleaning on a surface to be cleaned.

That is, the front wheels 700 and the rear wheels 620 are provided at the suction nozzle 10 such that the bottom of the suction nozzle 10 is spaced apart from the surface to be cleaned by a predetermined distance. The front wheels 700 and the rear wheels 620 support the suction nozzle 10 and, at the same time, smoothly move the suction nozzle 10.

A cleaning member 500 is provided at the lower part of the front of the suction nozzle 10. The cleaning member 500 scrapes or sweeps dust and foreign matter on a surface to be cleaned to smoothly perform cleaning.

In this embodiment, a brush 510 is used as the cleaning member 500. However, any member may be used as long as the member scrapes or sweeps dust and foreign matter on a surface to be cleaned. Embodiments of the present invention are not limited by kind of the cleaning member 500.

FIG. 3 is a perspective view showing a state in which the cover 100 of the suction nozzle 10 according to the embodiment of the present invention is removed. Hereinafter, components and functions of the suction nozzle 10 according to the embodiment of the present invention will be described in detail with reference to FIG. 3.

As previously described, the suction nozzle 10 mainly includes the suction nozzle body 200 and the cover 100. The suction nozzle body 200 is located at the lower part of the suction nozzle 10 to face a surface to be cleaned. At the upper part of the suction nozzle 10 is mounted a suction channel 300, along which suctioned air flows. The cover 100 is coupled to the suction nozzle body 200 to cover the upper part of the suction nozzle body 200.

Meanwhile, a suction portion (not shown) communicating with the suction channel 300 is formed at the bottom of the suction nozzle body 200. That is, the suction portion is formed by opening a portion of the bottom of the suction nozzle body 200. The suction portion communicates with the suction channel 300 mounted at the upper part of the suction nozzle body 200.

That is, the suction channel 300 is formed in the shape of a hollow box. One end of the suction channel 300 faces a communication channel 610, which will hereinafter be described, and the other end of the suction channel 300 communicates with the suction portion.

The suction pipe 630 provided at the rear of the suction nozzle 10 is connected between the suction channel 300 and the extension pipe 22. Consequently, air suctioned through the suction portion is introduced into the cleaner body 30 via the suction channel 300, the communication channel 610, the suction pipe 630, and the extension pipe 22 in order. In the cleaner body 30, dust and foreign matter are separated from the air.

Meanwhile, a link member 400 connected between the cleaning member 500 and a contact portion 430 is provided at opposite sides of the suction channel 300. The link member 400 includes interlocking levers 410 and the contact portion 430.

Each of the interlocking levers 410 is rotated about a first coupling member 412 to fasten the link member 400 to the suction channel 300.

In the suction channel 300 is provided a communication hole 310, through which air from the suction nozzle 10 is introduced into the suction channel 300. The contact portion 430 faces the communication hole 310.

That is, as the contact portion 430 comes into contact with or is separated from the suction channel 300 due to air introduced into the communication hole 310, the interlocking levers 410 connected to the contact portion 430 are rotated. As the interlocking levers 410 are rotated, the cleaning member 500 is moved upward or downward.

As previously described, the interlocking levers 410 are connected between the cleaning member 500 and the contact portion 430. Since the communication hole 310 is formed in the suction channel 300, the contact portion 430 is located higher than the cleaning member 500. For this reason, the interlocking levers 410 are bent.

Also, the interlocking levers 410 are provided at opposite sides of the suction channel 300. Between the interlocking levers 410 is connected a support bar 420 to improve durability of the link member 400.

Meanwhile, the cleaning member 500 connected to the interlocking levers 410 is disposed at one side of the suction nozzle body 200. That is, the cleaning member 500 is located at the lower part of the front of the suction nozzle 10 to scrape or sweep dust and foreign matter from a surface to be cleaned in a moving direction of the suction nozzle 10.

Meanwhile, the cleaning member 500 includes a moving frame 520, the brush 510, and pivot portions 530. The moving frame 520 moves as the interlocking levers 410 are rotated. The brush 510 is coupled to the lower side of the moving frame 520. Consequently, the moving frame 520 moves upward or downward according to rotation of the interlocking levers 410 based on kind of a surface to be cleaned, and the brush 510 coupled to the lower side of the moving frame 520 scrapes or sweeps the surface to be cleaned.

The pivot portions 530 provided at the upper side of the moving frame 520 are rotatably coupled to the other ends of the interlocking levers 410.

The pivot portions 530 extend upward from the moving frame 520. The pivot portions 530 are formed in a hollow shape such that second coupling members 414 to couple the interlocking levers 410 and the cleaning member 500 are inserted into the pivot portions 530. That is, the second coupling members 414 are fixedly inserted into second coupling holes (not shown) formed at the other ends of the interlocking levers 410 and the pivot portions 530. As a result, the interlocking levers 410 are connected to the cleaning member 500.

Meanwhile, when a user performs cleaning with respect to a surface to be cleaned, the suction nozzle 10 is moved back and forth. At this time, the moving frame 520 is rotated with respect to the interlocking levers 410 about the pivot portions 530. Consequently, connection portions between the interlocking levers 410 and the cleaning member 500 are prevented from being damaged due to fatigue caused by friction between the surface to be cleaned and the brush 510.

That is, when the suction nozzle 10 is moved forward, the moving frame 520 is rotated toward the rear of the suction nozzle 10 by friction between the brush 510 and the surface to be cleaned. On the other hand, when the suction nozzle 10 is moved backward, the moving frame 520 is rotated toward the front of the suction nozzle 10.

A push protrusion 450 is formed at the lower side of one end of each of the interlocking levers 410. At opposite sides of the suction channel 300 are formed support protrusions 320 such that the support protrusions 320 face the respective push protrusions 450. Between each of the push protrusions 450 and a corresponding one of the support protrusions 320 is disposed an elastic member 460 to smoothly rotate the interlocking levers 410 based on kind of a surface to be cleaned.

The operations of the push protrusions 450 and the support protrusions 320 in connection with the rotation of the interlocking levers 410 based on kind of a surface to be cleaned will hereinafter be described in detail.

Meanwhile, an indication protrusion 440 is formed at the top of the contact portion 430 facing the communication hole 310. The indication protrusion 440 is exposed through the indication slit 110 of the cover 100 to indicate kind of a surface on which cleaning is being performed.

That is, as the interlocking levers 410 coupled to the opposite sides of the suction channel 300 are rotated, the contact portion 430 connected to the interlocking levers 410 is also rotated by a predetermined angle. As the contact portion 430 is rotated, the indication protrusion 440 exposed through the indication slit 110 is changed. As a result, a user may be aware of kind of a surface on which cleaning is being performed.

The communication channel 610 is provided at the rear of the suction nozzle body 200 such that the communication channel 610 faces one end of the suction channel 300. The communication channel 610 is disposed between the suction pipe 630 and the suction channel 300 such that air from the suction channel 300 is introduced into the cleaner body 30 through the communication channel 610.

To the lower side of the suction channel 300 and the communication channel 610 is coupled a support member 600 configured such that one end of the suction channel 300 faces one end of the communication channel 610.

That is, the support member 600 is provided at the rear of the suction nozzle body 200, and fastening members are inserted through coupling pieces 602 provided at the support member 600 and coupling protrusions 330 provided at the suction channel 300 such that the suction nozzle body 200 is coupled to the support member 600.

The communication channel 610 communicating with the suction pipe 630 is provided on the support member 600. Consequently, the support member 600 connects the suction nozzle 10 to the suction pipe 630.

The rear wheels 620 are coupled to opposite sides of the support member 600 such that the suction nozzle 10 is smoothly moved with respect to a surface to be cleaned.

In addition, the front wheels 700 are coupled to opposite sides of the front of the suction nozzle body 200 to cooperate with the rear wheels 620 such that the suction nozzle 10 is smoothly moved with respect to a surface to be cleaned. That is, the front wheels 700 are coupled to the suction nozzle body 200 such that the front wheels 700 are provided at opposite sides of the cleaning member 500 to guide the suction nozzle 10 and, at the same time, to smoothly move the suction nozzle 10.

Also, as previously described, the front wheels 700 and the rear wheels 620 are provided at the suction nozzle 10 such that the bottom of the suction nozzle 10 is spaced apart from a surface to be cleaned by a predetermined distance. The front wheels 700 and the rear wheels 620 support the suction nozzle 10 and, at the same time, enable smooth introduction of air through the suction portion formed at the bottom of the suction nozzle 10.

Meanwhile, a cover coupling protrusion 710 is provided at the upper side of each of the front wheels 700 so that the cover 100 is coupled to the suction nozzle body 200 by the cover coupling protrusions 710.

FIG. 4 is a perspective view showing the communication hole 310, formed in the suction channel 300, and the contact portion 430, facing the communication hole 310, of the suction nozzle 10 according to the embodiment of the present invention. Hereinafter, contact or separation between the contact portion 430 and the suction channel 300 according to rotation of the interlocking levers 410 and operations of the push protrusions 450 and the support protrusions 320 will be described in detail with reference to FIG. 4.

For clarity, FIG. 4 shows the suction nozzle 10 from which the cover 100 is removed. Hereinafter, however, a description will be given on the assumption that the cover is coupled to the suction nozzle 10 although the cover 100 is not shown in FIG. 4.

As previously described, the push protrusion 450 is formed at the lower side of one end of each of the interlocking levers 410. The support protrusions 320 are formed at opposite sides of the suction channel 300 such that the support protrusions 320 face the respective push protrusions 450. Between each of the push protrusions 450 and a corresponding one of the support protrusions 320 is disposed a spring as the elastic member 460.

In this embodiment, the suction nozzle 10 of the vacuum cleaner in which the elastic members 460 are springs and the vacuum cleaner are illustrated and described. However, any members may be used as the elastic members 460 as long as the members exhibit predetermined elastic force to maintain a predetermined distance between each of the push protrusions 450 and a corresponding one of the support protrusions 320 when cleaning is not performed or in a case in which a surface to be cleaned is a hard floor. Embodiments of the present invention are not limited by kind of the elastic members 460.

Meanwhile, in a case in which a surface to be cleaned is a hard floor, the front wheels 700 and the rear wheels 620 support the suction nozzles 10 so that the bottom of the suction nozzle 10 is spaced apart from the surface to be cleaned by a predetermined distance.

As a result, air flowing in the suction channel 300 through the suction portion has relatively high pressure and thus forms a low vacuum pressure state. Consequently, the vacuum pressure is less than elastic force of the springs respectively disposed between the push protrusions 450 and the support protrusions 320.

As a result, a predetermined distance between the push protrusions 450 and the support protrusions 320 is maintained by the elastic force of the springs, and therefore, the interlocking levers 410 are rotated to the front of the suction nozzle 10 so that the cleaning member 500 is moved downward.

On the other hand, in a case in which a surface to be cleaned is a carpet, the front wheels 700 and the rear wheels 620 support the suction nozzles 10 and, at the same time, penetrate fibers densely formed at the top of the carpet. Consequently, the distance between the bottom of the suction nozzle 10 and the surface to be cleaned is reduced, and therefore, suction force is increased.

As a result, air flowing in the suction channel 300 through the suction portion has relatively low pressure and thus forms a high vacuum pressure state. Consequently, the vacuum pressure is greater than elastic force of the springs respectively disposed between the push protrusions 450 and the support protrusions 320.

As a result, air flowing in the suction channel 300 suctions air from the suction nozzle 10 into the suction channel 300 through the communication hole 310 formed in the suction channel 300 at high vacuum pressure, and the contact portion 430 located above the communication hole 310 comes into contact with the suction channel 300 by the air suctioned into the suction channel 300.

Consequently, the interlocking levers 410 connected to the contact portion 430 are rotated to the rear of the suction nozzle 10 so that the cleaning member 500 is moved upward.

FIG. 5 is a side view showing a state in which the cover 100 of the suction nozzle 10 according to the embodiment of the present invention is removed in a case in which a surface to be cleaned is a hard floor, and FIG. 6 is a front view showing a state in which the cover 100 of the suction nozzle 10 according to the embodiment of the present invention is removed in a case in which the surface to be cleaned is the hard floor. Hereinafter, the operation of the cleaning member 500 during cleaning of the hard floor will be described in detail with reference to FIGS. 5 and 6.

Suction force of the suction nozzle 10 with respect to a surface to be cleaned is closely related to the distance between the bottom of the suction nozzle 10 having the suction portion and the surface to be cleaned.

That is, as the distance between the bottom of the suction nozzle 10 and the surface to be cleaned is decreased, suction force increases, and therefore, air flowing in the suction channel 300 has low pressure. On the other hand, as the distance between the bottom of the suction nozzle 10 and the surface to be cleaned is increased, suction force decreases, and therefore, air flowing in the suction channel 300 has high pressure.

The distance between the bottom of the suction nozzle 10 and the surface to be cleaned in a case in which the surface to be cleaned is a hard floor is greater than that between the bottom of the suction nozzle 10 and the surface to be cleaned in a case in which the surface to be cleaned is a carpet. In a case in which the surface to be cleaned is the hard floor, therefore, suction force of the suction nozzle 10 decreases.

As a result, air flowing in the suction channel 300 has relatively high pressure. Consequently, force to suction air from the suction nozzle 10 into the suction channel 300 through the communication hole 310 is less than elastic force of the springs respectively disposed between the push protrusions 450 and the support protrusions 320.

As a result, a predetermined distance between the push protrusions 450 and the support protrusions 320 is maintained by the elastic force of the springs, and therefore, the contact portion 430 remains spaced apart from the communication hole 310 formed in the suction channel 300, and the interlocking levers 410 are rotated to the front of the suction nozzle 10 about the first coupling members 412 to fasten the link members 400 to the suction channel 300. Consequently, the cleaning member 500 cleans the surface to be cleaned, i.e. the hard floor, in a state in which the cleaning member 500 has been moved downward.

FIG. 7 is a side view showing a state in which the cover 100 of the suction nozzle 10 according to the embodiment of the present invention is removed in a case in which a surface to be cleaned is a carpet, and FIG. 8 is a front view showing a state in which the cover 100 of the suction nozzle 10 according to the embodiment of the present invention is removed in a case in which the surface to be cleaned is a carpet. Hereinafter, the operation of the cleaning member 500 during cleaning of the carpet will be described in detail with reference to FIGS. 7 and 8.

In a case in which a surface to be cleaned is a carpet as shown in FIGS. 7 and 8, the front wheels 700 provided at the suction nozzle 10 and the rear wheels penetrate fibers densely formed at the top of the carpet. Consequently, the distance between the bottom of the suction nozzle 10 and the surface to be cleaned is reduced, and therefore, suction force in a case in which the surface to be cleaned is a carpet is greater than that in a case in which the surface to be cleaned is a carpet.

As a result, air flowing in the suction channel 300 has relatively low pressure, and therefore, force to suction air from the suction nozzle 10 into the suction channel 300 through the communication hole 310 is greater than elastic force of the springs respectively disposed between the push protrusions 450 and the support protrusions 320.

As a result, and the contact portion 430 located above the communication hole 310 comes into contact with the suction channel 300, and the push protrusions 450 formed at the lower side of the contact portion 430 are moved toward the respective support protrusions 320, whereby the springs respectively disposed between the push protrusions 450 and the support protrusions 320 are compressed.

Consequently, the interlocking levers 410 are rotated to the rear of the suction nozzle 10 about the first coupling members 412 to fasten the link members 400 to the suction channel 300. As the interlocking levers 410 are rotated, the cleaning member 500 is moved upward to clean the surface to be cleaned, i.e. the carpet.

That is, the cleaning member 500, specifically the brush 510, is moved upward so as not to penetrate fibers densely formed at the top of the carpet. Consequently, the suction nozzle 10 is smoothly moved on the carpet to easily remove dust and foreign matter from the surface of the carpet.

In the suction nozzle 10 of the vacuum cleaner according to the embodiment of the present invention, therefore, the cleaning member 500 is moved upward or downward based on kind of a surface to be cleaned, thereby efficiently performing cleaning. Also, the position of the cleaning member 500 is automatically adjusted according to the change of suction force based on kind of a surface to be cleaned even if a user does not directly adjust the position of the cleaning member 500, thereby maximizing user convenience.

FIG. 9 is a perspective view showing an indication protrusion 440 according to an embodiment of the present invention in a case in which a surface to be cleaned is a hard floor, and FIG. 10 is a perspective view showing the indication protrusion 440 according to the embodiment of the present invention in a case in which a surface to be cleaned is a carpet. Hereinafter, the indication protrusion 440 to inform a user of kind of a surface to be cleaned will be described in detail with reference to FIGS. 9 and 10.

As previously described, suction force is relatively low in a case in which a surface to be cleaned is a hard floor, and therefore, the interlocking levers 410 remain rotated to the front of the suction nozzle 10.

The indication protrusion 440 formed on the contact portion 430 connected to the interlocking levers 410 is formed in the shape of a triangular prism. A front surface and a rear surface of the indication protrusion 440, exposed to a user, have different colors. Consequently, the rear surface of the indication protrusion 440 is exposed through the indication slit 110 formed at the cover 100 on the basis of the cleaning direction of the suction nozzle 10.

On the other hand, in a case in which the surface to be cleaned is a carpet, suction force is relatively high, and therefore, the interlocking levers 410 remain rotated to the rear of the suction nozzle 10.

Also, the front surface of the indication protrusion 440 is exposed through the indication slit 110 formed at the cover 100 on the basis of the cleaning direction of the suction nozzle 10.

Consequently, it is possible for the user to be aware of kind of a surface on which cleaning is being performed based on the color of the indication protrusion 440 exposed through the indication slit 110. Also, in a case in which a surface on which cleaning is being performed does not coincide with a surface to be cleaned indicated by the color of the indication protrusion 440, it is possible for the user to easily check if the suction nozzle 10 malfunctions.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A suction nozzle of a vacuum cleaner comprising:

a suction nozzle body having a suction portion for air suction;

a suction channel, provided at the suction nozzle body, in which air suctioned through the suction portion flows;

a communication hole provided in the suction channel;

a contact portion selectively coming into contact with the communication hole to block air flow from outside the suction channel to inside the suction channel or separated from the communication hole to allow air flow from outside the suction channel to inside the suction channel according to change of pressure in the suction channel, the contact portion being provided outside the suction nozzle body;

an interlocking lever provided at the suction nozzle body and connected to the contact portion such that the interlocking lever is operated according to motion of the contact portion; and a cleaning member provided at the interlocking lever to move upward or downward according to the operation of the interlocking lever, the cleaning member being provided at a lower part of the suction nozzle to contact a surface to be cleaned in order to scrape or sweep dust and foreign matter on the surface to be cleaned when the surface to be cleaned is a hard floor, wherein the contact portion is separated from the communication hole and the cleaning member moves downward when the surface to be cleaned is a hard floor, and wherein the contact portion comes into contact with the communication hole and the cleaning member moves upward when the surface to be cleaned is a carpet.

2. The suction nozzle according to claim 1, wherein the interlocking lever is rotatably coupled to each side of the suction channel and is rotated according to the motion of the contact portion.

3. The suction nozzle according to claim 1, wherein the cleaning member comprises:

a moving frame to move upward or downward according to the operation of the interlocking lever; and a brush fixed to one side of the moving frame.

4. The suction nozzle according to claim 3, wherein the cleaning member further comprises a pivot portion provided at an other side of the moving frame and rotatably coupled to one end of the interlocking lever.

5. The suction nozzle according to claim 1, wherein the interlocking lever has a push protrusion disposed at a lower side of the contact portion, the suction channel has a support protrusion facing the push protrusion, and an elastic member is disposed between the push protrusion, and the support protrusion.

6. The suction nozzle according to claim 5, wherein the elastic member comprises a spring.

7. The suction nozzle according to claim 1, further comprising an indication protrusion formed on the contact portion to indicate a position of the cleaning member.

8. The suction nozzle according to claim 7, further comprising a cover coupled to the suction nozzle body to cover an upper part of the suction nozzle body, the cover having an indication slit, through which the indication protrusion is exposed.

9. The suction nozzle according to claim 1, further comprising:

front wheels coupled to the suction nozzle body such that the front wheels are provided at opposite sides of the cleaning member; and rear wheels coupled to opposite sides of a support member fastened to the suction nozzle body and the suction channel.

10. A suction nozzle of a vacuum cleaner comprising:

a suction nozzle body having a suction portion for air suction;

a suction channel, provided at the suction nozzle body such that the suction channel communicates with the suction portion, in which air suctioned through the suction portion flows;

a communication hole provided in the suction channel;

a contact portion selectively contacting with the communication hole to block air flow from outside the suction channel to inside the suction channel or separated from the communication hole to allow air flow from outside the suction channel to inside the suction channel according to change of pressure in the suction channel, the contact portion being provided outside the suction nozzle body;

a link member rotatably coupled to the suction channel; and a cleaning member coupled to one end of the link member, wherein the cleaning member moves upward or downward according to the rotation of the link member, the cleaning member being provided at a lower part of the suction nozzle to contact a surface to be cleaned in order to scrape or sweep dust and foreign matter on the surface to be cleaned when the surface to be cleaned is a hard floor, wherein the cleaning member includes:

a moving frame to move upward or downward;

a brush fixed to one side of the moving frame; and pivot portions disposed at other side of the moving frame to rotatably connect the moving frame to the link member, wherein the contact portion is separated from the communication hole and the cleaning member moves downward when the surface to be cleaned is a hard floor, and wherein the contact portion contacts the communication hole and the cleaning member moves upward when the surface to be cleaned is a carpet.

11. The suction nozzle according to claim 10, further comprising:

first coupling members to fasten the link member to the suction channel, wherein the first coupling members are inserted into first coupling holes formed at opposite sides of the link member and through holes formed at opposite sides of the suction channel, and the link member comprises:

interlocking levers rotated about the first coupling members; and a contact portion provided at one-side ends of the interlocking levers.

12. The suction nozzle according to claim 11, wherein the contact portion is provided to face the communication hole such that the contact portion selectively comes into contact with or is separated from the communication hole according to change of pressure in the suction channel, and the interlocking levers are rotated according to motion of the contact portion.

13. The suction nozzle according to claim 12, further comprising:

an indication protrusion formed on the contact portion to indicate a position of the cleaning member; and a cover coupled to the suction nozzle body to cover an upper part of the suction nozzle body, the cover having an indication slit, through which the indication protrusion is exposed.

14. The suction nozzle according to claim 11, wherein pivot portions is rotatably connected to second coupling holes formed at an other-side ends of the interlocking levers.

15. A vacuum cleaner comprising:

a cleaner body;

a vacuum motor provided at the cleaner body; and a suction nozzle to suction air using suction force generated by the vacuum motor, wherein the suction nozzle comprises:

a suction nozzle body having a suction portion for air suction;

a suction channel, provided at the suction nozzle body, in which air suctioned through the suction portion flows;

a communication hole provided in the suction channel;

a contact portion selectively coming into contact with the communication hole to block air flow from outside the suction channel to inside the suction channel or separated from the communication hole to allow air flow from outside the suction channel to inside the suction channel according to change of pressure in the suction channel, the contact portion being provided outside the suction channel, the contact portion being provided outside the suction nozzle body;

an interlocking lever provided at the suction nozzle body and connected to the contact portion such that the interlocking lever is operated according to motion of the contact portion; and a cleaning member provided at the interlocking lever to move upward or downward according to the operation or the interlocking lever, the cleaning member being provided at a lower part of the suction nozzle to contact a surface to be cleaned in order to scrape or sweep dust and foreign matter on the surface to be cleaned when the surface to be cleaned is a hard floor and to move upward in order not to contact the surface to be cleaned when the surface to be cleaned is a carpet, wherein the contact portion is separated from the communication hole and the cleaning member moves downward when the surface to be cleaned is a hard floor, and wherein the contact portion contacts the communication hole and the cleaning member moves upward when the surface to be cleaned is a carpet.

16. The vacuum cleaner of claim 15, further comprising an extension pipe and a connection pipe to connect the suction nozzle to the cleaner body.

17. The vacuum cleaner of claim 15, wherein the cleaning member includes:

a moving frame to move upward or downward;

a brush fixed to one side of the moving frame.

18. The vacuum cleaner of claim 17, wherein the cleaning member further includes pivot portions disposed at other side of the moving frame to rotatably connect the moving frame to the interlocking lever.

19. The vacuum cleaner of claim 15, wherein the suction nozzle further comprises a cover coupled to the suction nozzle body to cover an upper part of the suction nozzle body.

20. The vacuum cleaner of claim 19, wherein the suction nozzle further comprises an indication protrusion to indicate a position of the cleaning member and the cover has an indication slit though which the indication protrusion is exposed.

* * * * *